US006170982B1

(12) United States Patent
Graber

(10) Patent No.: US 6,170,982 B1
(45) Date of Patent: Jan. 9, 2001

(54) WATCH, IN PARTICULAR A POCKET WATCH

(75) Inventor: Edmund W Graber, Bienne (CH)

(73) Assignee: Aveda SA, Fribourg (CH)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/038,051

(22) Filed: Mar. 11, 1998

(30) Foreign Application Priority Data

Mar. 13, 1997 (EP) ..... 97810140

(51) Int. Cl.[7] ..... G04B 37/00
(52) U.S. Cl. ..... 368/311; 368/319
(58) Field of Search ..... 368/311, 289–291, 368/319–321

(56) References Cited

U.S. PATENT DOCUMENTS 222,235 12/1879 Breese .
298,615 5/1884 O'Hara .
469,660 * 2/1892 erbeau ..... 368/311
780,287 * 1/1905 hardy ..... 368/311
3,765,165 * 10/1973 Vial ..... 368/311

FOREIGN PATENT DOCUMENTS 0 388 138 9/1990 (EP) .

* cited by examiner

*Primary Examiner*—Bernard Roskoski
(74) *Attorney, Agent, or Firm*—Oliff & Berridge, PLC

(57) ABSTRACT

Pocket watch comprising a middle, a movement accommodated in the middle, a crystal, a cover for protecting the crystal, a stem for setting the time of the movement, and a device for locking the cover. The locking device can be released by manipulating the stem to open the cover. A water-tight enclosure enables the movement to be accommodated and protected. The water-tight enclosure encloses the middle. The locking device is outside the water-tight enclosure. The stem passes through the water-tight enclosure through an aperture and a water-tight joint provided in the aperture. The water-tight enclosure includes a casing ring accommodated inside the watch-case.

16 Claims, 2 Drawing Sheets

WATCH, IN PARTICULAR A POCKET WATCH

BACKGROUND OF THE INVENTION

1. Field of the Invention

This invention relates to a watch, in particular a pocket watch.

2. Description of Related Art

Wristwatches have become largely indispensable even though they have drawbacks such as reduced wearing comfort and bad protection of the watch, in particular of the crystal, against shocks and scratches. For these reasons other types of watches continue to enjoy a certain popularity which does not diminish. Pocket watches in particular, also called fob watches, have been a craze on a par with the fashion of the waistcoat or vest. Generally, the present invention concerns all watches intended to be worn, or carried with you, other than on your wrist, for example brooch-watches, lapel-watches, pendant-watches, châtelaine-watches, clip-watches, etc.

These watches generally comprise a movement accommodated in a watch-case as well as, in the case of watches of the hunter type, a cover permitting the protection of the crystal and/or the dial of the watch. Such a cover is necessary to protect the watch from dust and from scratches in particular when it is being transported in a pocket with other objects, possibly sharp or blunt. Likewise known are wristwatches provided with a cover; the invention equally applies to this type of wristwatch. Such a cover is frequently decorated or ornamented with fine workmanship.

The watch is set to the time, and in the case of a mechanical watch, wound, by means of a winding stem passing through the watch-case. This winding stem is frequently connected to the locking means for the cover in such a way that the cover can be opened by manipulating the winding stem, for example by pushing the winding crown. At least one spring element is generally provided to obtain an automatic and rapid opening of the cover as soon as the locking means have been released by actuation of the winding stem.

Owing to the weight of the cover, the spring element must be relatively thick and thus bulky. The locking means are thus likewise bulky and moreover relatively complex. Consequently, it is difficult to obtain good tightness in this portion of the watch around the winding stem. Therefore one has often had to be content with producing watches which were not protected against humidity.

SUMMARY OF THE INVENTION

One object of the present invention is thus to propose an improved watch, in particular a watch having a well-balanced combination of advantageous features such as tightness, cost price, solidity, simplicity of construction, aesthetics, etc.

This object is attained according to the invention with a watch comprising a middle, a movement accommodated in said middle, a crystal, a protective cover for said crystal, a time-setting stem for the movement, a water-tight enclosure permitting said movement to be accommodated and protected, locking means for said cover, said locking means being able to be released by manipulating said stem so as to open the cover, the locking means being outside said water-tight enclosure, said stem passing through said water-tight enclosure through an aperture, a water-tight joint being provided in said aperture.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the invention will be described in detail hereinafter with reference to the accompanying drawings.

Figure 1:
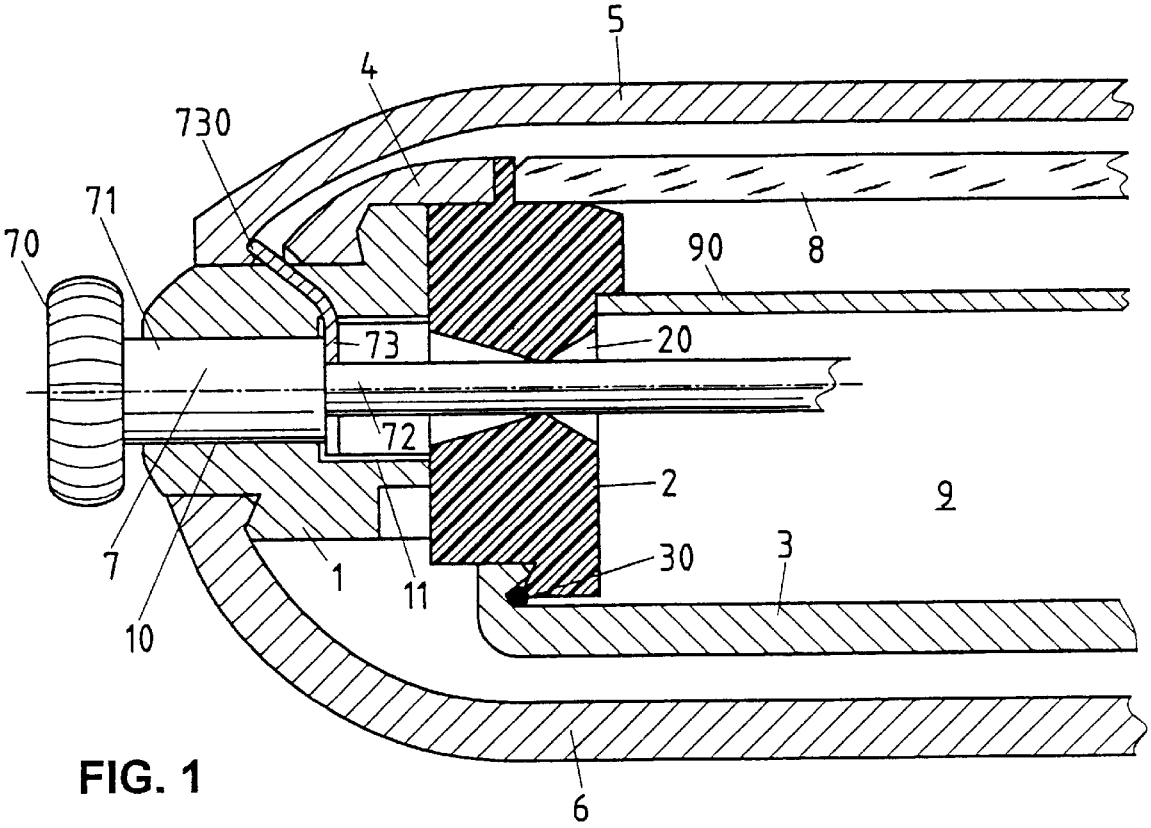
FIG. 1 is a profile section of a portion of the watch incorporating an example embodiment of the water-tight enclosure according to the present invention.

FIG. 1 shows a section through half of a watch, seen in profile. Only the elements necessary for comprehension of the invention have been illustrated. The example illustrated represents the particular case of a pocket watch of the hunter type. However, the invention applies equally to other types of watches provided with a cover. Various elements would have to be modified, depending upon the type of watch chosen and the aesthetics of the watch.

The case of the pocket watch shown is made up of a middle 1 and a removable back cover 6, in this example a back fixed by snap. The back could also be equally well screwed or made integral with the middle. Neither gaskets nor any special means of ensuring tightness have been provided at the interface between the middle 1 and the back 6. A cover 5 on top of the crystal 8 and the dial 90 can be opened to read the time and closed again for carrying the watch. The cover is preferably articulated about a hinge (not shown) situated opposite the stem 7, that is generally at 6 o'clock. Spring means (not shown), for example means combined with said hinge, enable an automatic and quick opening of the cover 5 to be achieved. These elements are known to one skilled in the art, and thus will not be described in further detail.

A stem 7 passes through the middle 1 by mean of an aperture 10, preferably at 12 o'clock. The middle can possibly be provided with a pendant and/or with a bow at 12 o'clock, in particular in the case of a watch suspended on a chain. The stem 7 provided with a crown 70 allows the movement 9 in the watch to be set to the time, and, in the case of a mechanical movement, allows the watch to be wound. In the case of a complicated watch, it is also possible to have several stems or push buttons similar to stem 7. Water-tight joints such as those described in the foregoing would have to be provided then for each of the stems.

Figure 1A:
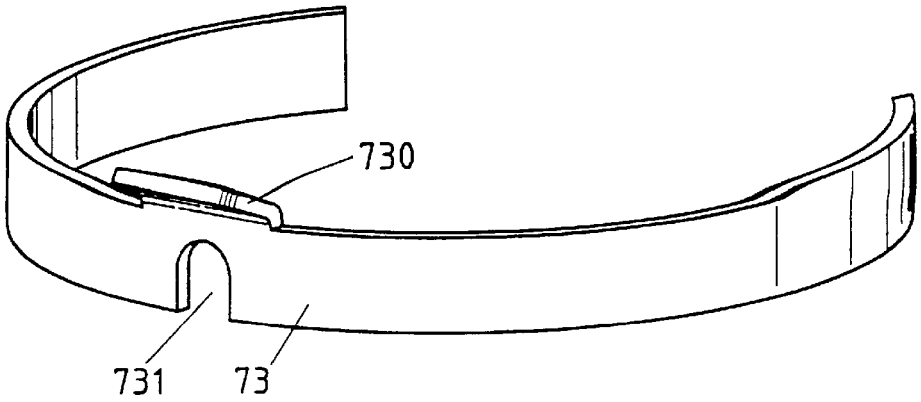
FIG. 1*a* is a view in perspective of the spring blade used in the watch of FIG. 1.

The aperture 10 through the middle has a diameter just slightly larger than the outer diameter of the stem 7. A peripheral groove 11, of rectangular section, is provided at least on one annular segment of the inner face of the middle 1, in such a way that the aperture 10 extends to the bottom of the groove 11. An annular spring blade 73, shown in perspective in FIG. 1*a*, is disposed in the groove 11. The radius of curvature in the resting state of the spring blade is greater than the radius of curvature of the groove 11, so that the spring blade 73 tends to spread apart and be pressed into the groove 11. The stem 7 passes through the spring blade to come out of the aperture 10. The diameter of the portion 71 of the stem in the aperture 10 is greater than the diameter of the portion 72 passing through the passage 731 in the spring blade so that the spring blade comes to push against a projection of the stem 7 at the place where it changes diameter. The projection can be obtained by profile turning of the stem 7 or by inserting a tube around the stem of constant diameter. The spring blade 73 consequently pushes back the stem 7 toward the outside. A locking element 730, integral with the spring blade, comes to press against the inner face of the cover 5 so as to keep the cover closed.

By pressing on the end of the stem 7 with sufficient force to compensate the action of the spring blade 73, one manages to detach the latter from the bottom of the groove 11. The locking element 730 then releases itself from the cover 5, thus causing the abrupt opening of the latter under the effect of the hinge spring just mentioned. By closing the cover 5 again manually, the locking element 730, brought back into locking position by the force of the spring 73, presses itself again against the cover. No action upon the stem 7 is thus necessary to lock the cover.

In the example illustrated, the stem 7 and the crown 70 form one piece. The opening of the cover 5 by pressing on the crown thus involves an axial displacement of the stem toward the interior of the movement 9. Certain movements, however, do not withstand such a displacement. In that case, the stem or the crown can be made up of a plurality of pieces able to slide axially, independently from one another. For example, portion 71 of the stem can be made up of a tube integral with the crown 70 and able to slide axially about the inner stem 7.

It is understood that other types of locking devices are conceivable. In particular, the invention applies also to watches whose cover is opened by pulling a stem or a knob rather than by pushing a stem or button. Minor adaptations of the device, which has been described here by way of example, would suffice to achieve this end.

No special precautions have been taken in this example to protect the locking mechanism described above from the infiltration of humidity or dust from outside.

According to the invention, the movement 9 is accommodated in a water-tight enclosure 2, 3, 8 inside the middle 1. The water-tight enclosure in this example is made up of a casing ring 2, a back 3 and the crystal 8. The casing ring 2 can be fixed to the middle 1 by any means; for example, if the ring 2 is made of plastic, it can be simply pressed into the aperture inside the middle. Other fixing means, for example by screwing, can also be provided, however.

The time-setting stem 7 passes through the casing ring 2 through an aperture 20. Water-tight means are provided to prevent the infiltration of water through this aperture. In this first example, which is adapted to a plastic ring 2, the water-tight means are simply made up of an aperture portion of reduced diameter. A water-tight joint 30 is foreseen moreover at the interface between the ring 2 and the back 3, and preferably likewise at the interface between the crystal 8 and the ring 2 (not shown). In the case of a plastic casing ring 2, it may also be possible to do without such joints between the ring and the back or the crystal, the tightness being ensured in this case by the compressibility of the material. The movement 9, as well as the dial 90 and the crystal 8, are fixed directly to the casing ring 2. A bezel 4 covers over the middle partially and the ring 2 almost totally, leaving only the small portion of the ring 2 appear, acting as a water-tight joint between the bezel 4 and the crystal 8.

In a variant (not shown), the ring 2 is totally covered over by the bezel 4. The crystal can be held by the bezel rather than by the casing ring. The bezel 4 is preferably prolonged up to the dial 90, so as to conceal the ring 2 completely, which can then be produced at a reduced cost without any aesthetic concerns. For example, it is possible to make a bezel 4 and/or a middle 1 of gold, completely covering over a casing ring 2 made of more economical material, for example steel, brass or plastic.

Figure 2:
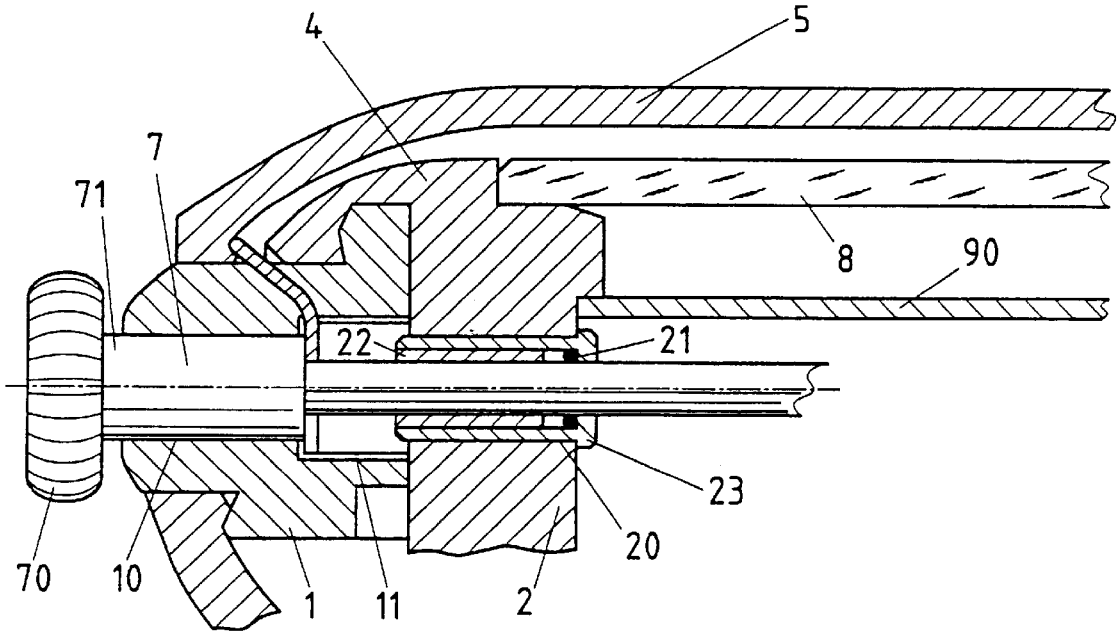
FIG. 2 is a profile section of the casing ring and of the bezel in a variant of the invention.

FIG. 2 illustrates a variant in which the casing ring 2 and the bezel 4 form a single piece. A sleeve 23 inserted in the aperture 20 enables prevention of infiltration of water and of dust around the stem 7. For this purpose, the sleeve 23 is preferably provided with water-tight joints 21 and 22.

Figure 3:
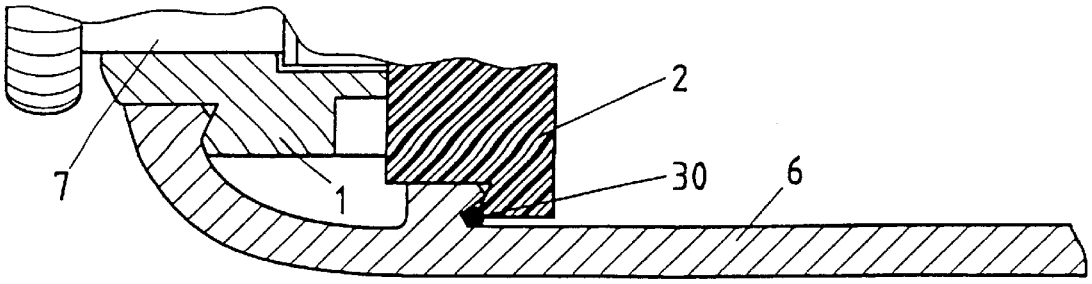
FIG. 3 is a profile section of a detail of the casing ring and of the back of the watch in another variant of the invention.

FIG. 3 illustrates another variant of the invention, able to be combined with any of the variants above. In this case, one of the walls of the water-tight enclosure protecting the movement is constituted by the back cover of the watch-case 6. Thus it is not necessary to provide a supplementary back 3, which makes it possible to reduce costs and also reduce the thickness of the entire watch. However, this variant requires supplementary machining operations for the back cover 6 to fix it to the ring 2, which can add to the cost of the back cover, particularly if the back is made of a costly material.

Other embodiments of the tight enclosure can be conceived, for example an enclosure made entirely by plastic injection.

While the invention has been described with reference to what are considered to be preferred embodiments thereof, it is to be understood that the invention is not limited to the disclosed embodiments or constructions. To the contrary, the invention is intended to cover various modifications and equivalent arrangements included within the spirit and scope of the appended claims.

What is claimed is:

1. A watch comprising:

a time setting stem with a first portion and a second portion that move as one piece;

a watch case having a water tight enclosure comprising:

a movement accommodated in the water tight enclosure; and an aperture with a water tight joint accommodating the second portion of the time setting stem;

a crystal;

a protective cover for the crystal; and means for locking said cover, wherein the locking means is released by manipulating the time setting stem so as to open the cover, the locking means being outside the water-tight enclosure, the second portion of the time setting stem passing through the aperture.

2. The watch of claim 1, wherein said water-tight enclosure includes a casing ring accommodated inside the watch-case.

3. The watch of claim 2, wherein said water-tight enclosure includes a back which is distinct from the back of the watch-case.

4. The watch of claim 3, wherein said back distinct from the back of the watch-case is fixed in a removable way on said casing ring.

5. The watch of claim 4, wherein said back distinct from the back of the watch case and said casing ring form a single piece.

6. The watch of claim 2, wherein said water-tight enclosure is closed off on one face by the back of the watch-case.

7. The watch of claim 2, wherein the casing ring is made of plastic.

8. The watch of claim 2, further comprising a bezel which is integral with said casing ring.

9. The watch of claim 8, wherein said bezel and said casing ring form a single piece.

10. The watch of claim 8, wherein the bezel allows the casing ring to be concealed when the cover is open.

11. The watch of claim 2, wherein the dial and the crystal are fixed to said casing ring.

12. A watch comprising:

a time setting stem with a first portion and a second portion that move as one piece;

a watch case having a water-tight enclosure comprising: a movement accommodated in the water-tight enclosure; and an aperture with a water-tight joint accommodating the second portion of the time setting stem inside of a rubber grommet;

a crystal;

a protective cover for the crystal; and means for locking the cover wherein the locking means is released by manipulating the time setting stem so as to open the cover, the locking means being outside of the water-tight enclosure, the second portion of the time setting stem passing through the aperture.

13. A watch comprising:

a time setting stem with a first portion and a second portion that move as one piece;

a watch case having a water-tight enclosure comprising: a movement accommodated in the water-tight enclosure; and an aperture with a water-tight joint accommodating the second portion of the time setting stem inside of a slidable rubber ring enclosed within a sleeve;

a crystal;

a protective cover for the crystal; and means for locking the cover wherein the locking means is released by manipulating the time setting stem so as to open the cover, the locking means being outside of the water-tight enclosure, the second portion of the time setting stem passing through the aperture.

14. A watch according to claim 1, wherein the time setting stem is able to move rotationally and axially.

15. A watch according to claim 12, wherein the time setting stem is able to move rotationally and axially.

16. A watch according to claim 13, wherein the time setting stem is able to move rotationally and axially.

* * * * *